US006484534B2

(12) United States Patent
Tranier

(10) Patent No.: US 6,484,534 B2
(45) Date of Patent: Nov. 26, 2002

(54) PROCESS AND PLANT FOR SEPARATING AIR BY CRYOGENIC DISTILLATION

(75) Inventor: Jean-Pierre Tranier, L'Hay-les-Roses (FR)

(73) Assignee: L'Air Liquide, Societe Anonyme a Directoire et Conseil de Surveillance pour l'Etude et l'Exploitation des Procedes George Claude, Paris (FR)

( * ) Notice: Subject to any disclaimer, the term of this patent is extended or adjusted under 35 U.S.C. 154(b) by 0 days.

(21) Appl. No.: 09/799,735

(22) Filed: Mar. 7, 2001

(65) Prior Publication Data

US 2002/0134105 A1 Sep. 26, 2002

(30) Foreign Application Priority Data

Mar. 7, 2000 (FR) ..... 0002924

(51) Int. Cl.[7] ..... F25J 3/04
(52) U.S. Cl. ..... 62/646; 42/654
(58) Field of Search ..... 62/646, 654, 901

(56) References Cited

U.S. PATENT DOCUMENTS 3,392,536 A 7/1968 Smith
5,379,599 A * 1/1995 Mostello ..... 62/25
5,596,885 A 1/1997 Grenier
5,832,748 A * 11/1998 Bonaquist ..... 62/647
6,082,135 A * 7/2000 Duke et al. ..... 62/646

FOREIGN PATENT DOCUMENTS

EP 0 589 646 A1 3/1994
EP 0 810 412 A3 12/1997
EP 0 810 412 A2 12/1997

* cited by examiner

*Primary Examiner*—William C. Doerrler
*Assistant Examiner*—Malik N. Drake
(74) *Attorney, Agent, or Firm*—Young & Thompson

(57) ABSTRACT

An air separation plant producing pressurized gaseous oxygen includes at least one column having a bottom reboiler. The column is fed with a stream of air. The bottom reboiler is warmed by a nitrogen-enriched gas compressed in a cold compressor and pumped liquid oxygen is withdrawn from the bottom of the column, pumped and vaporized. The refrigeration for the process is produced by air expansion in a turbine.

23 Claims, 3 Drawing Sheets

PROCESS AND PLANT FOR SEPARATING AIR BY CRYOGENIC DISTILLATION

BACKGROUND OF THE INVENTION

The present invention relates to a process and a plant for separating air by cryogenic distillation, and in particular a process for producing pressurized gaseous oxygen, and possibly gaseous nitrogen, using a single column.

Since the beginning of the century, air distillation has been carried out in a double column comprising a medium-pressure column and a low-pressure column connected by a heat exchanger.

Several solutions have been proposed in various patents to reduce the number of columns from two to one.

U.S. Pat. No. 4,947,649 describes a solution in which air is compressed before being at least partially introduced into a single column. Such a solution is applicable only if it is desired to produce nitrogen at a pressure substantially higher than atmospheric pressure, especially in the case of integration with a gas turbine. On the other hand, if the pressure of the air delivered by the gas turbine compressor is very high, it is hardly recommendable to use this process since the distillation at high pressure (a pressure above 15 bar) is very difficult and poses not insignificant technological problems when the pressure approaches the supercritical pressure of nitrogen (33 bar). The other drawback of the cycle described in that patent is that the gaseous oxygen is produced at the same pressure as the air sent into the single column.

EP-A-0 584 420 relates to a single column which produces oxygen and nitrogen using a top condenser and two reboilers operating at between 5 and 20 bar. One of the reboilers is warmed with compressed nitrogen at ambient temperature and then cooled.

Patent EP-B-0 606 027 also describes a single-column process for producing pressurized oxygen and/or nitrogen, together with at least one liquid product. Such a process is not beneficial if it is not desired to produce liquid products since the air pressure depends eminently on the amount of liquid produced. When producing no or little liquid, the air pressure is less than 3 bar abs, which poses problems in the design of the top purification, which requires an enormous amount of absorbent, making this process uneconomic. U.S. Pat. No. 5,794,458 also describes an air distillation process using a single column. The main criticism that can be levelled at such an arrangement is that it includes a cold compressor which compresses a fluid very rich in oxygen. Moreover, the compression of the air is conventionally carried out in one or more compressors operating at ambient temperature.

DE-A-1 199 293 describes an air distillation process in which a stream of air is separated in a single column and a stream of liquid oxygen is withdrawn from the bottom of the column and vaporized by heat exchange with a stream of cycle nitrogen compressed in a cold compressor. A portion of the nitrogen compressed in the cold compressor to between 30 and 40 atma serves to reboil the single column. In this case, it is necessary to warm the nitrogen in order to compress it before cooling it and liquefying it against the oxygen which vaporizes. This is expensive in terms of energy and complicates the construction of the exchangers.

U.S. Pat. No. 5,475,980 describes a double-column air distillation process which, in a novel manner, proposes to compress a portion of the air needed for the distillation in a cold compressor. The drawback of such a solution is the complexity of the exchange line from which the cold fluid to be compressed is withdrawn before reintroducing it therein.

SUMMARY OF THE INVENTION

In the air distillation processes according to the invention using a single column, a cold compressor compresses a fluid whose oxygen content does not exceed 30 mol % . Another advantage of such an arrangement is that it is better in terms of energy than the arrangement described in U.S. Pat. No. 5,794,458 since the turbine of the invention, working on a fluid entering the cold box and not a fluid leaving the cold box, the amount of heat exchanged in the main exchanger is markedly less, and hence there are fewer irreversibilities. Another aspect of the invention is that it produces oxygen at a pressure greater than the pressure of the single column by compressing an oxygen-rich liquid (either by pump or by net positive suction head) at a pressure greater than that of the single column and by vaporizing it either by indirect heat exchange in a main exchanger or an external vaporizer, or by direct contact in a mixing column. Finally, the coproduction of liquid products in addition to the gas products is not necessary in order to make this process attractive, even though it is possible.

The ambient temperature is defined by the temperature at the intake of the main air compressor for feeding the separation unit.

According to the invention, a process for separating air by cryogenic distillation is provided, comprising the steps of:

compressing the air, purifying it and sending at least one portion thereof to a first (or the) column;

separating air in the column at cryogenic temperature;

compressing at least one portion of a fraction containing at most 30 mol % of oxygen extracted from the column in a compressor, the intake temperature of which is below room temperature;

at least partially cooling the said compressed fraction and condensing it by vaporizing an internal fluid of the first column or a fluid extracted therefrom, and possibly after having enriched it with nitrogen; and extracting an oxygen-rich liquid fraction from the first column, pressurizing it to a pressure above that of the column and vaporizing it by direct or indirect heat exchange with a portion of the feed air in order to form an oxygen-rich pressurized gas product.

According to other aspects of the invention:

a nitrogen-rich gas product is withdrawn from the top of the first (or the) column;

a fraction containing at most 30 mol % of oxygen extracted from the column is compressed in a compressor whose intake temperature is below the ambient temperature to a pressure of less than 30 bar abs;

the pressure in the first (or the) column is between 1.3 and 20 bar abs, preferably between 3 and 10 bar abs;

the compressed fraction contains at most 19 mol % of oxygen and at least 81 mol % of nitrogen, preferably at least 90 mol % of nitrogen;

at least one portion of the air is expanded in a turbine before being sent to the first (or the) column;

the production of work by the expansion of at least one portion of the air is at least partially used to compress the fraction containing at most 30% oxygen in one or more compression stages;

at least one portion of the air is compressed to a high pressure, condensed and sent to the first (or the) column;

an unexpanded portion of the air is condensed by vaporizing an internal fluid of the first column or a fluid withdrawn therefrom (FIG. 2);

the oxygen-rich liquid fraction is vaporized by direct contact in an auxiliary column called a mixing column (FIG. 3);

an auxiliary column intended for argon production is fed from the first column (FIG. 4);

an oxygen-enriched liquid withdrawn from the single column is distilled in an auxiliary column in order to produce a fraction richer in oxygen and a fraction depleted in oxygen, both fractions being reintroduced into the first column (FIG. 5);

at least one portion of the air intended for a column of the apparatus comes from the compressor of a gas turbine and/or a nitrogen-enriched gas coming from the first (or the) column is sent back to the gas turbine system;

the inlet pressure of the gas turbine is greater than 15 bar abs;

the purity of the gaseous oxygen produced is at least 80 mol %, preferably at least 90 mol %;

the intake temperature of the cold compressor is below −100° C. or preferably below −150° C.;

liquid may or may not be produced as final product;

the compressed fraction at least partially condenses in the bottom reboiler of the first (or the) column;

the stream of air which is used to vaporize the oxygen-rich liquid at least partially condenses and is sent to the first column;

the compressed fraction is enriched with nitrogen in a distillation column thermally coupled to the first column.

According to another aspect of the invention, a plant for separating air by distillation in at least a first column is provided, this column having a bottom reboiler, comprising means for sending compressed and purified air to the column, a compressor for compressing a gas containing at most 30 mol % of oxygen coming from the column having an inlet temperature of at most 5° C. warmer than a temperature of the column, optionally means for enriching the compressed gas with nitrogen upstream of the reboiler, means for sending the compressed gas to the bottom reboiler, means for sending the at least partially compressed gas condensed in the bottom reboiler back to the column, means for withdrawing an oxygen-enriched liquid from the bottom of the first column, means for pressurizing it and means for vaporizing the pressurized liquid by heat exchange, in order to form an oxygen-rich pressurized gas product, characterized in that it includes means for vaporizing the pressurized liquid by direct or indirect heat exchange and, if the exchange is indirect, the heat exchange takes place with air intended for the first column.

According to other inventive aspects:

the apparatus comprises a turbine fed with air and the outlet of the turbine is connected to the first column;

the pressurized liquid vaporizes in a mixing column;

the apparatus comprises an argon production column fed from the first column having a bottom reboiler;

the column having a bottom reboiler has at least one intermediate condenser;

the column having a bottom reboiler does not have a top condenser;

there is a second column thermally coupled to the first column, which optionally includes means for sending the overhead gas from the second column to the bottom reboiler;

there are means for sending the gas compressed in the compressor into the bottom of the second column.

BRIEF DESCRIPTION OF THE DRAWINGS

The invention will now be described with reference to FIGS. 1 to 6 which are schematic representations of plants according to the invention.

DETAILED DESCRIPTION OF THE PREFERRED EMBODIMENTS

Figure 1:
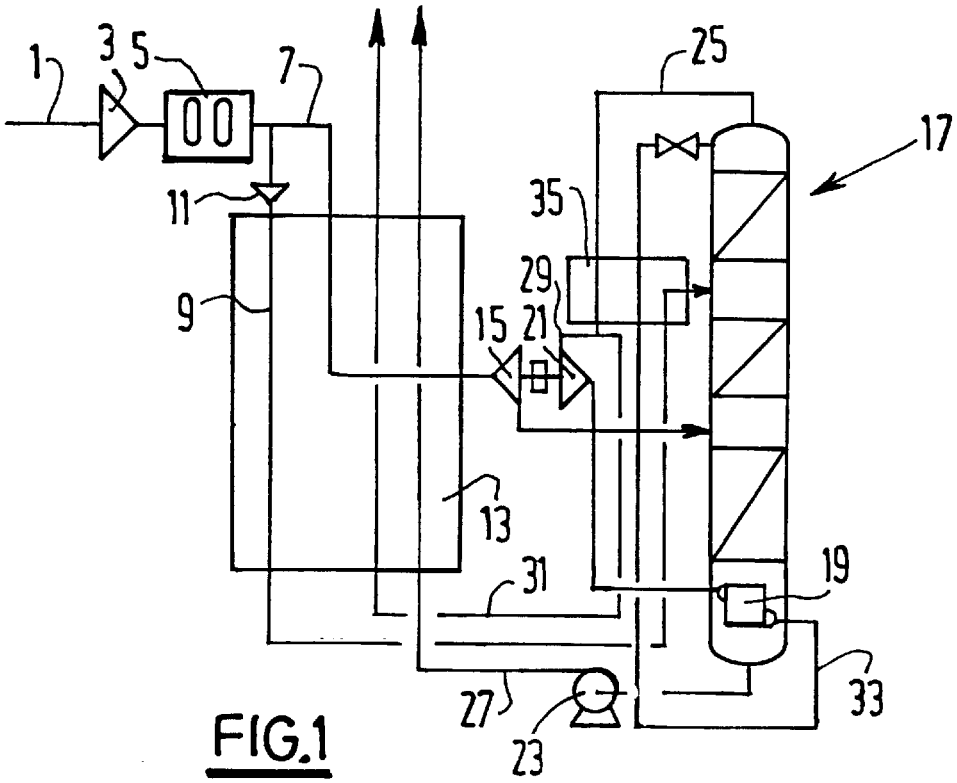
FIG. 1 is a schematic representation of a first embodiment of the invention.

In FIG. 1, the air 1 is compressed in the compressor 3, purified at 5 and divided into two. The fraction 7 is partially cooled in the exchanger 13 and sent to a turbine 15 in which it expands before being sent to the first column 17. The rest of the air 9 (about 35%) is supercharged in the supercharger 11 and then passes through the exchanger 13 where it condenses before being sent to the column, after a subcooling step in the exchanger 35, a few trays above the point of injection of the air from the turbine 15. The column operates at a pressure of between 1.2 and 1.3 bar abs, but this process can be used up to pressures of 20 bar abs and preferably less than 10 bar abs.

Oxygen 27 is withdrawn from the bottom of the column, pressurized by the pump 23 and sent to the exchanger 13 where it vaporizes.

Nitrogen 25 from the top of the column is warmed in the subcooler 35 before being divided into two. A portion 31 is sent to the exchanger 13 where it warms up. The rest 29 is sent to the compressor 21 with an inlet temperature of −182° C., where it is compressed to 4.9 bar, before being sent to the bottom reboiler 19 of the first column 17. There it condenses and is sent back to the top of the column as reflux 33. The turbine 15 is coupled to the cold compressor 21.

Figure 2:
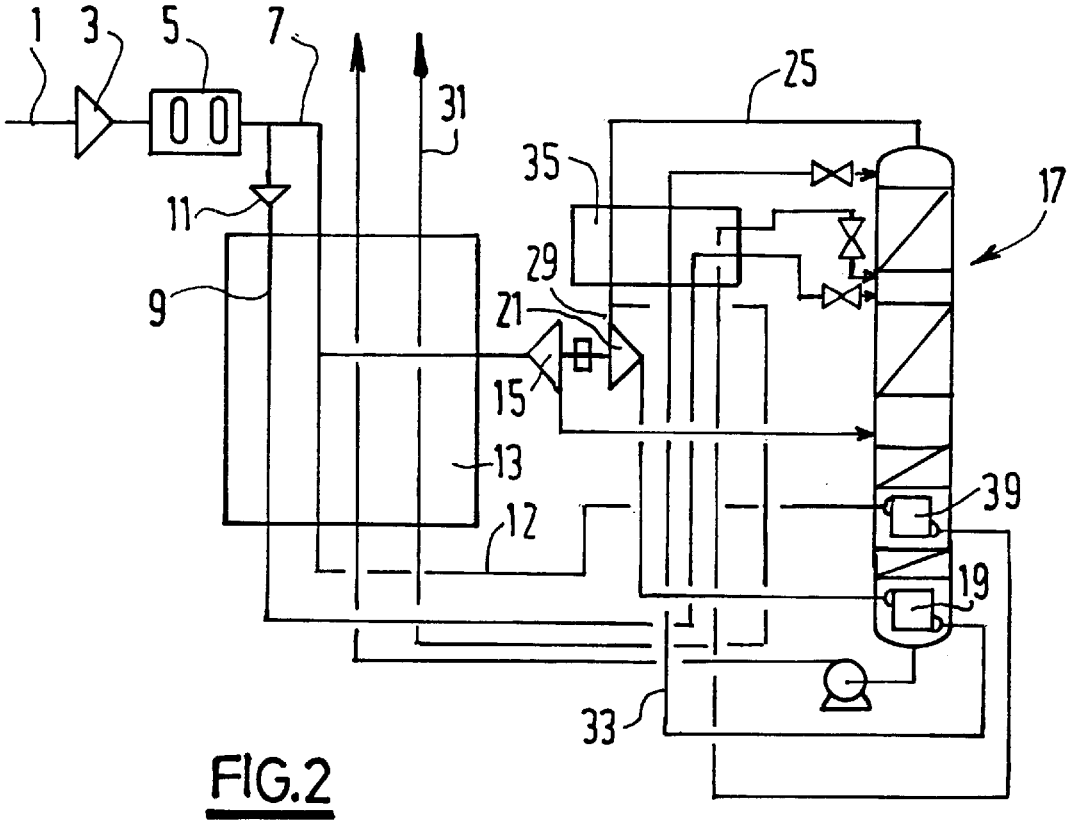
FIG. 2 is a schematic representation of a second embodiment of the invention.

FIG. 2 shows the same streams 7, 25, 27, 31, but only a portion of the stream 7 is sent to the turbine 15. A portion 12 of the non-supercharged stream 7 passes entirely through the exchanger and is sent to an intermediate reboiler 39 of the column 17. The air thus condensed is sent to the column with the air 9.

Oxygen 27 is withdrawn from the bottom of the column, pressurized by the pump 23 and sent to the exchanger 13 where it vaporizes.

Likewise, it is conceivable, by adjusting the pressures, to send the cycle nitrogen to the intermediate condenser 39 and the air 12 to the bottom reboiler 19. It would be conceivable to have a cold booster 21 with several stages in series, each feeding an intermediate or bottom reboiler. In general, the cold booster 21 may have several stages in series, each driven by a turbine, or combined into a single turbine, for example by means of a multiplier.

Nitrogen 25 from the top of the column is warmed in the subcooler 21 before being divided into two. A portion 31 is sent to the exchanger 13 where it warms up. The rest 29 is sent to the compressor 21 with an inlet temperature of −182° C., where it is compressed to 4.9 bar before being sent to the bottom reboiler 19 of the first column 17 (the pressure could be 4 bar if the nitrogen is sent to the intermediate reboiler). There it condenses and is sent back to the top of the column as reflux. The turbine 15 is coupled to the cold compressor 21.

Figure 3:
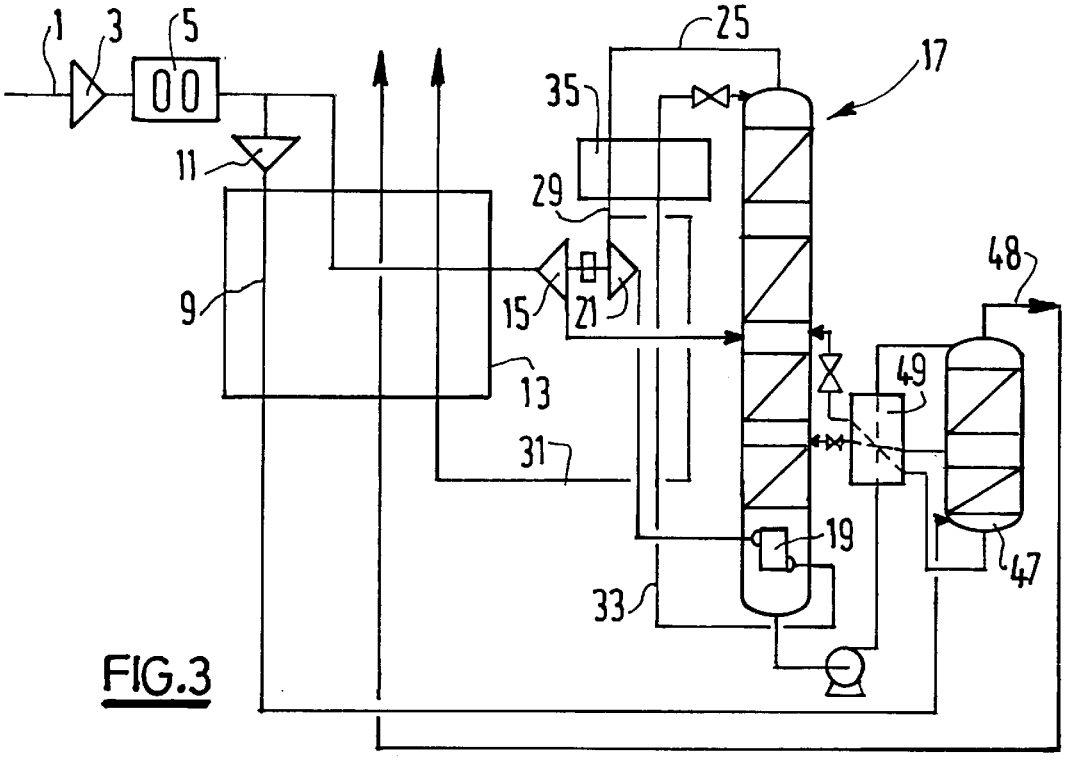
FIG. 3 is a schematic representation of a third embodiment of the invention.

FIG. 3 shows the case in which the pressurized oxygen from the bottom of the column vaporizes by direct heat exchange in a mixing column.

The air 1 is compressed in the compressor 3, purified at 5 and divided into two. The fraction 7 is partially cooled in the exchanger 13 and sent to a turbine 15 in which it expands before being sent to the first column 17. The rest of the air 9 (about 25%) is supercharged in the supercharger 11 and then passes through the exchanger 13. The first column 17 operates at a pressure of between 3 and 20 bar.

The stream of air 9 does not liquefy in the exchanger but is sent in gaseous form into the bottom of the mixing column. Thus, the mixing column operates at a higher pressure than the first column 17. It is conceivable to make the two columns operate at the same pressure or to make the mixing column operate at the lower pressure. The mixing column is fed at the top with pumped oxygen coming from the bottom of the first column 17, but it may be fed at the top with another stream which is less rich in oxygen than the pumped stream or at the bottom with air coming from a source other than the compressor 1.

Nitrogen 25 from the top of the column is warmed in the subcooler 35 before being divided into two. A portion 31 is sent to the exchanger 13 where it warms up. The rest 29 is sent to the compressor 21 with an inlet temperature of −182° C. where it is compressed to 4.9 bar before being sent to the bottom reboiler 19 of the first column 17. There it condenses and is sent back to the top of the column as reflux. The turbine 15 is coupled to the cold compressor 21.

Here an exchanger 49 warms the pumped oxygen sent to the top of the mixing column 47. The intermediate liquid stream from the mixing column is sent to the column 17 and the impure oxygen 48 withdrawn from the top of the latter is sent to the exchanger 13.

Figure 4:
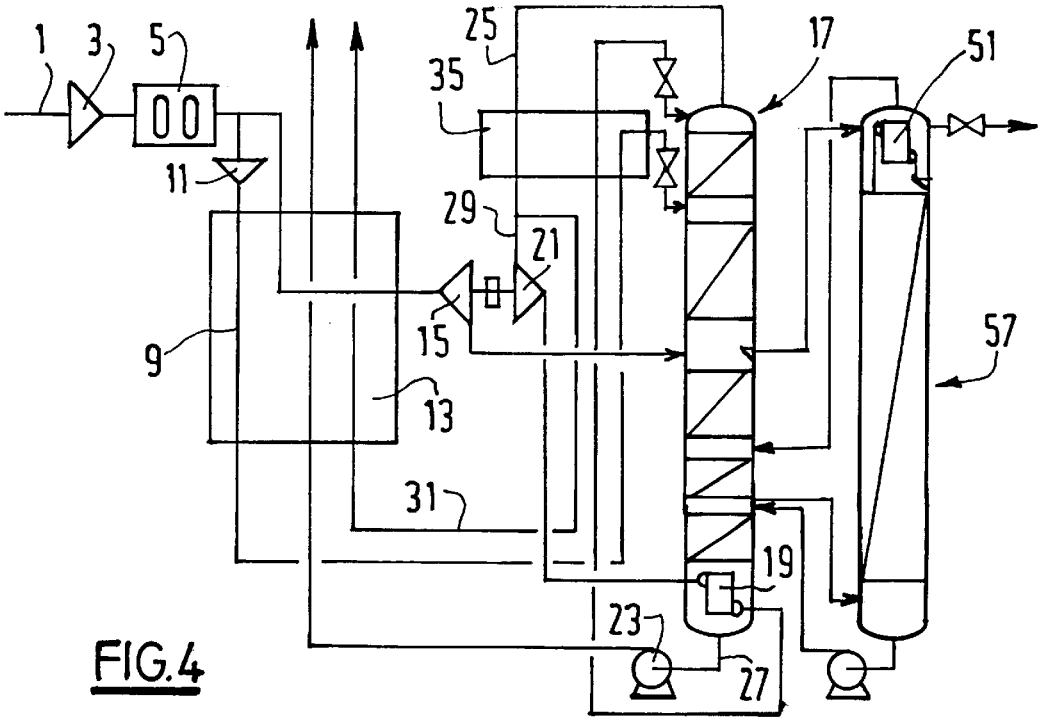
FIG. 4 is a schematic representation of a fourth embodiment of the invention.

The version in FIG. 4 illustrates the case in which an argon-enriched stream from the column 17 feeds a mixing column 57 having a top condenser 51 cooled by an intermediate liquid from the first column 17. An argon-enriched fluid is withdrawn from the top of the mixing column 57.

Nitrogen 25 from the top of the column is warmed in the subcooler 35 before being divided into two. A portion 31 is sent to the exchanger 13 where it warms up. The rest 29 is sent to the compressor 21 with an inlet temperature of −182° C. where it is compressed to 4.9 bar before being sent to the bottom reboiler 19 of the first column 17. There it condenses and is sent back to the top of the column as reflux. The turbine 15 is coupled to the cold compressor 21.

Oxygen 27 is withdrawn from the bottom of the column, pressurized by the pump 23 and sent to the exchanger 13 where it vaporizes.

Figure 5:
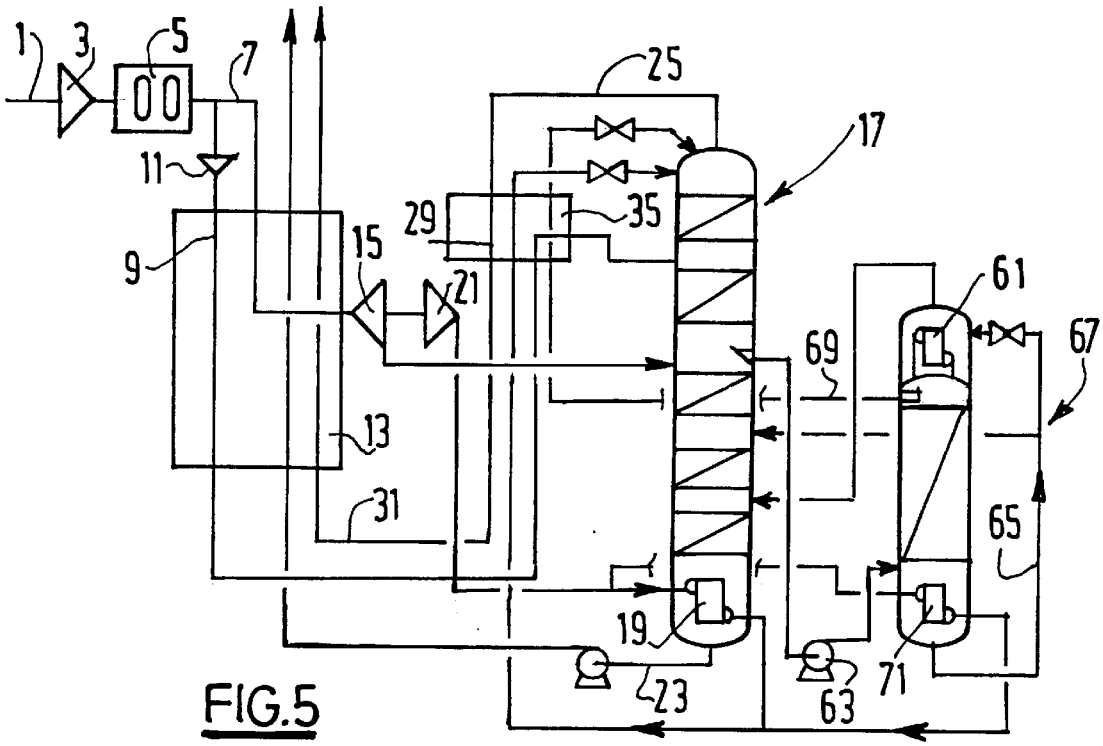
FIG. 5 is a schematic representation of a fifth embodiment of the invention.

FIG. 5 shows an Etienne column 67 fed at the bottom with a liquid stream withdrawn a few trays below the point of injection of the air 9 and at the same level as the blown air 7. This liquid is pressurized by the pump 63 before being sent to the Etienne column. The liquid formed at the top of the Etienne column 67 is sent to the top of the first column 17.

The Etienne column operating at 2.5 bar has a top condenser 61 cooled by a portion of the bottom liquid 65 from the same column, the rest of the liquid being sent to the column 17 below the point of injection of the blown air 7.

The expanded liquid vaporizes in the condenser 61 before being sent a few trays above the condenser 19 of the column 17.

Nitrogen 25 from the top of the column is warmed in the subcooler 35 before being divided into two. A portion 31 is sent to the exchanger 13 where it warms. The rest 29 is sent to the compressor 21 with an inlet temperature of −182° C. where it is compressed to 4.9 bar before being sent to the reboilers 19, 69 of the columns 17, 67, respectively. In each reboiler, it condenses and is sent back to the top of the column 17 as reflux. The turbine 15 is coupled to the cold compressor 21.

Oxygen 27 is withdrawn from the bottom of the column, pressurized by the pump 23 and sent to the exchanger 13 where it vaporizes.

Figure 6:
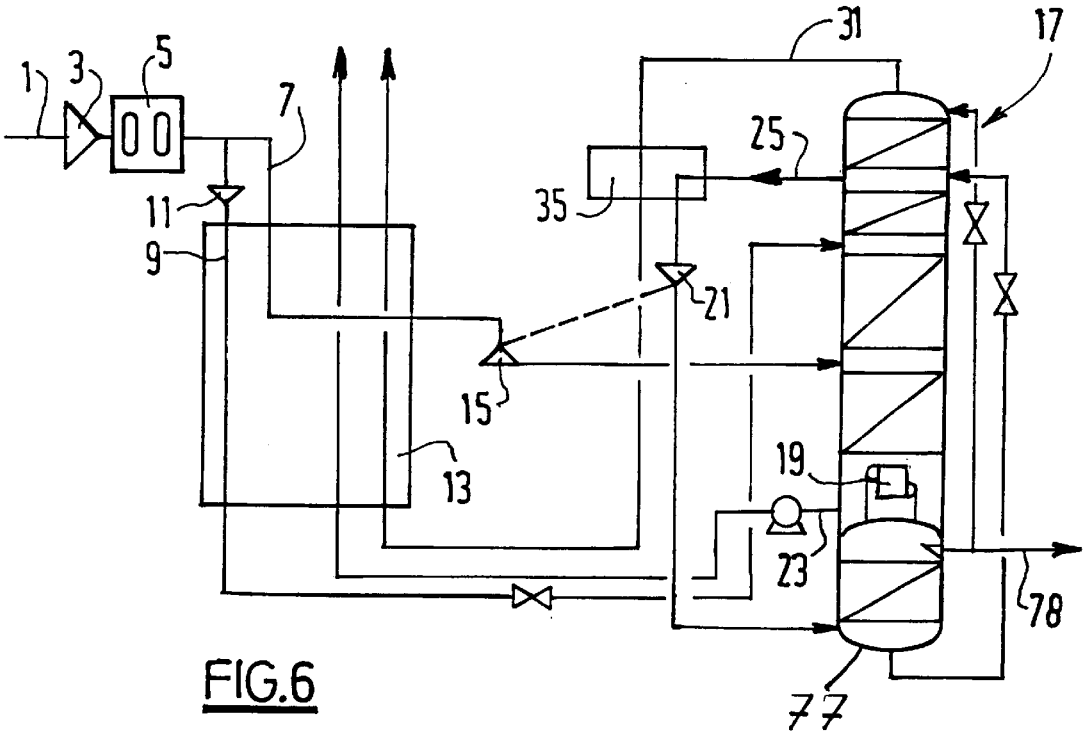
FIG. 6 is a schematic representation of a sixth embodiment of the invention.

In FIG. 6, a stream of air 7 is expanded in a turbine 15 and sent to the middle of the first column 17 operating between 1.5 and 20 bar. A gas 25 from the first column is warmed in the subcooler 35, compressed in the cold compressor 35 and sent as a single feed into the bottom of a second column 77, operating at a higher pressure than the first column. The top of the second column 77 is coupled to the bottom of the first column 17 by means of a reboiler 19. A stream of liquid nitrogen 78 is withdrawn from the top of the second column. The stream of air 9 is supercharged and used to vaporize the liquid oxygen.

Thus, the gas compressed in the cold compressor 21 is enriched with nitrogen before being sent to the reboiler 19. Other enriching means, such as a membrane, could be provided.

The liquid from the bottom of the second column is expanded and sent to the first column at the level for withdrawal of the gas 25 to be compressed in the cold compressor 35. A gas 31 richer in nitrogen than the gas 25 is withdrawn from the apparatus.

What is claimed is:

1. Process for separating air by cryogenic distillation in an apparatus comprising at least one column, comprising the steps of:

compressing the air, purifying the air and sending at least one portion thereof to a first column;

separating air in the column at cryogenic temperature;

compressing at least one portion of a fraction containing at most 30 mol % of oxygen extracted from the column in a compressor, the intake temperature of which is below room temperature;

at least partially cooling the compressed fraction and condensing the compressed fraction by vaporizing an internal fluid of the first column or a fluid extracted therefrom; and extracting an oxygen-rich liquid fraction from the first column, pressurizing the oxygen-rich liquid fraction to a pressure above that of the column and vaporizing the oxygen-rich liquid fraction by direct or indirect heat exchange with a portion of the feed air in order to from an oxygen-rich pressurized gas product.

2. Process according to claim 1, in which the compressed fraction (25) contains at most 19 mol % of oxygen and at least 81 mol % of nitrogen.

3. Process according to claim 1, in which at least one portion of the air is expanded in a turbine before being sent to the first column.

4. Process according to claim 3, in which the production of work by the expansion of at least one portion of the air is at least partially used to compress the fraction containing at most 30 % oxygen in one or more compression stages.

5. Process according to claim 1, in which at least one portion of the air is compressed to a high pressure, condensed and sent to the first column.

6. Process according to claim 5, in which an unexpanded portion of the air is condensed by vaporizing an internal fluid of the first column or a fluid withdrawn therefrom.

7. Process according to claim 1, in which the oxygen-rich liquid fraction is vaporized by direct contact in an auxiliary mixing column.

8. Process according to claim 1, in which an auxiliary column intended for argon production is fed from the first column.

9. Process according to claim 1, in which an oxygen-enriched liquid withdrawn from the first column is distilled in an auxiliary column in order to produce a fraction richer in oxygen and a fraction depleted in oxygen, both fractions being reintroduced into the first column.

10. Process according to claim 1, in which at least one of at least one portion of the air intended for a column of the apparatus comes from the compressor of a gas turbine and a nitrogen-enriched gas coming from the first column is sent back to the gas turbine system.

11. Process according to claim 10, in which the inlet pressure of the gas turbine is greater than 15 bar abs.

12. Process according to claim 1, in which the in take temperature of the cold compressor is below −100° C.

13. Process according to claim 12, in which the intake temperature of the cold compressor (21) is below −150° C.

14. Process according to claim 1, in which the compressed fraction at least partially condenses in a bottom reboiler of the first column.

15. Process according to claim 1, in which the compressed fraction is enriched with nitrogen in a second distillation column thermally coupled to the first column.

16. Plant for separating air by distillation in at least a first column (17) having a bottom reboiler (19), comprising means (7) for sending compressed and purified air to the first ( or the) column, a compressor (21) for compressing a gas (25) containing at most 30 mol % of oxygen coming from the column having as inlet temperature of at most 5° C. warmer than a temperature of the first (or the) column, means for sending the compressed gas to the bottom reboiler, means (33) for sending the at least partially compressed gas condensed in the bottom reboiler (19) back to the column, optionally means for enriching the compressed gas with nitrogen upstream of the reboiler, means (27) for withdrawing an oxygen-enriched liquid from the bottom of the column, means (23) for pressurizing it and means (19, 47) for vaporizing the pressurized liquid by direct or indirect heat exchange, characterised in that it includes means for vaporizing the pressurized liquid by direct or indirect heat exchange and, if the exchange is direct, the heat exchange takes place with air (9) intended for the first column.

17. Plant according to claim 16, comprising an air expansion turbine (15), in which the outlet of the turbine is connected to the first (or the) column.

18. Plant according to either of claims 16 and 17, in which the pressurized liquid vaporizes in a mixing column (47).

19. Plant according to one of claims 16 to 18, comprising an argon production column (57) fed from the column (17) having a bottom reboiler (19).

20. Plant according to one of claims 16 to 19, in which the column (17) having a bottom reboiler (19) has at least one intermediate condenser (39).

21. Plant according to one of claims 16 to 20, in which the column (17) having a bottom reboiler (19) does not have a top condenser.

22. Plant according to one of claims 16 to 21, comprising a second column (77) thermally coupled to the first column, which optionally includes means for sending the overhead gas from the second column to the bottom reboiler (19) (FIG. 6).

23. Plant according to claim 22, comprising means for sending the gas compressed in the compressor (21) into the bottom of the second column (77).

* * * * *